US009282866B2

(12) United States Patent
Miefalk et al.

(10) Patent No.: US 9,282,866 B2
(45) Date of Patent: Mar. 15, 2016

(54) VACUUM CLEANER WITH RETRACTABLE AUXILIARY SUCTION HOSE

(75) Inventors: Håkan Miefalk, Järfälla (SE); Oskar Lindström, Slona (SE); Roger Karlsson, Stockholm (SE); Niklas Hansson, Sollentuna (SE); Esbjörn Svantesson, Täby (SE)

(73) Assignee: AB Electrolux (SE)

( * ) Notice: Subject to any disclaimer, the term of this patent is extended or adjusted under 35 U.S.C. 154(b) by 506 days.

(21) Appl. No.: 13/517,482

(22) PCT Filed: Dec. 17, 2010

(86) PCT No.: PCT/SE2010/000306

§ 371 (c)(1),
(2), (4) Date: Jun. 20, 2012

(87) PCT Pub. No.: WO2011/078758

PCT Pub. Date: Jun. 30, 2011

(65) Prior Publication Data

US 2013/0283561 A1 Oct. 31, 2013

Related U.S. Application Data

(60) Provisional application No. 61/289,913, filed on Dec. 23, 2009.

(30) Foreign Application Priority Data

Dec. 22, 2009 (SE) ..... 0901601-5

(51) Int. Cl.
*A47L 5/32* (2006.01)
*A47L 9/24* (2006.01)
(Continued)

(52) U.S. Cl.
CPC ..... *A47L 9/244* (2013.01); *A47L 5/225* (2013.01); *A47L 5/32* (2013.01); *A47L 9/0036* (2013.01); *A47L 9/24* (2013.01)

(58) Field of Classification Search
CPC ..... A47L 5/28; A47L 9/0036; A47L 9/244; A47L 5/32; A47L 9/24; A47L 5/225; H01L 21/67
USPC ..... 15/334
IPC ..... A47L 5/32
See application file for complete search history.

(56) References Cited

U.S. PATENT DOCUMENTS 1,217,817 A 2/1917 Peters
1,907,644 A 5/1933 Fairfax
(Continued)

FOREIGN PATENT DOCUMENTS

CN 1942130 4/2007
DE 3429878 A1 2/1986
(Continued)

OTHER PUBLICATIONS

First Office Action with English translation for Application No. CN200980154777.0 dated Apr. 3, 2013.
(Continued)

*Primary Examiner* — David Redding
(74) *Attorney, Agent, or Firm* — RatnerPrestia

(57) ABSTRACT

An upright vacuum cleaner (1) comprises a main body (2) having arranged therein a suction chamber (3), a fan unit (4), a first suction duct (5), a second suction duct (6) and a valve arrangement (7) operable to establish communication between each of the first and second suction ducts and the suction chamber. A floor nozzle arrangement (8) is provided at a first end (9) of the main body and in communication with said first suction duct. An auxiliary nozzle (10) for above-floor cleaning is provided, and an extensible and/or collapsible suction hose (12) connects the auxiliary nozzle to said second suction duct. The cleaner (1) has handle means (11) comprising an elongated recess (13) adapted to contain the greater part of the suction hose. The recess (13) may be open at one end or may be shaped as an open groove.

13 Claims, 4 Drawing Sheets

(51) Int. Cl.
*A47L 5/22* (2006.01)
*A47L 9/00* (2006.01)

(56) References Cited

U.S. PATENT DOCUMENTS

| | | | | |
|---|---|---|---|---|
| 2,416,418 | A | 2/1947 | Taylor | |
| 2,504,846 | A * | 4/1950 | Kirby | 15/319 |
| 2,660,457 | A | 11/1953 | Mallon | |
| 2,719,318 | A | 10/1955 | Tschudy | |
| 2,867,833 | A | 1/1959 | Duff | |
| 4,373,228 | A | 2/1983 | Dyson | |
| 4,376,322 | A | 3/1983 | Lockhart et al. | |
| 4,519,113 | A | 5/1985 | Hipple | |
| 4,571,772 | A | 2/1986 | Dyson | |
| 4,955,106 | A | 9/1990 | Stein et al. | |
| 5,247,720 | A | 9/1993 | Sovis et al. | |
| 5,477,586 | A | 12/1995 | Jacobs et al. | |
| 5,500,979 | A | 3/1996 | Wörwag | |
| 5,560,074 | A | 10/1996 | Graham et al. | |
| 5,617,611 | A | 4/1997 | Wörwag | |
| 5,732,439 | A | 3/1998 | Cipolla | |
| 5,797,162 | A | 8/1998 | Vystrcil et al. | |
| 5,815,883 | A | 10/1998 | Stein et al. | |
| 5,836,047 | A | 11/1998 | Lee et al. | |
| 6,058,559 | A | 5/2000 | Yoshimi et al. | |
| 6,295,694 | B1 | 10/2001 | Dyson et al. | |
| 6,317,920 | B1 | 11/2001 | Brickner et al. | |
| 6,442,791 | B1 | 9/2002 | McRae Thomson et al. | |
| 6,510,584 | B2 | 1/2003 | Vystrcil et al. | |
| 6,526,623 | B1 | 3/2003 | Dyson | |
| 6,572,078 | B1 | 6/2003 | Thomson et al. | |
| 7,000,288 | B2 | 2/2006 | Nighy | |
| 7,036,183 | B2 | 5/2006 | Gammack et al. | |
| 7,069,619 | B2 | 7/2006 | Bowden et al. | |
| 7,350,263 | B2 | 4/2008 | Yoshimi et al. | |
| 7,356,874 | B2 | 4/2008 | Macleod | |
| 7,367,081 | B2 * | 5/2008 | O'Neal | A47L 5/225 15/320 |
| 7,533,441 | B2 | 5/2009 | Yoo | |
| 7,555,810 | B2 | 7/2009 | Pullins et al. | |
| 7,685,648 | B2 | 3/2010 | Kenney | |
| 7,832,050 | B2 | 11/2010 | Pullins et al. | |
| 7,945,988 | B2 | 5/2011 | Gordon | |
| 7,979,952 | B2 | 7/2011 | Beskow et al. | |
| 8,032,982 | B2 | 10/2011 | Lee et al. | |
| 8,108,967 | B2 * | 2/2012 | Wood | 15/410 |
| 8,122,566 | B2 | 2/2012 | Sepke et al. | |
| 8,127,398 | B2 * | 3/2012 | Conrad | 15/327.5 |
| 8,205,294 | B2 | 6/2012 | Kim et al. | |
| 8,793,836 | B2 * | 8/2014 | Postle et al. | 15/412 |
| 2004/0135537 | A1 * | 7/2004 | Conner | A01D 34/82 318/701 |
| 2004/0194251 | A1 | 10/2004 | Overvaag et al. | |
| 2004/0255426 | A1 | 12/2004 | Davis et al. | |
| 2006/0026788 | A1 | 2/2006 | Fischer et al. | |
| 2006/0026789 | A1 | 2/2006 | Fischer et al. | |
| 2006/0026791 | A1 | 2/2006 | Fischer et al. | |
| 2006/0070204 | A1 | 4/2006 | Blocker et al. | |
| 2006/0070205 | A1 | 4/2006 | Fischer et al. | |
| 2006/0070206 | A1 | 4/2006 | Fischer et al. | |
| 2006/0143852 | A1 | 7/2006 | Lee et al. | |
| 2006/0179607 | A1 | 8/2006 | Ptak et al. | |
| 2006/0185115 | A1 | 8/2006 | Yoo | |
| 2006/0230572 | A1 | 10/2006 | Lee et al. | |
| 2006/0282976 | A1 | 12/2006 | Richardson et al. | |
| 2007/0028413 | A1 | 2/2007 | Fischer et al. | |
| 2007/0039121 | A1 | 2/2007 | Choi | |
| 2007/0256271 | A1 | 11/2007 | Rhea | |
| 2008/0022485 | A1 | 1/2008 | Grey | |
| 2008/0072397 | A1 | 3/2008 | Overvaag et al. | |
| 2008/0148512 | A1 | 6/2008 | Beskow et al. | |
| 2008/0282495 | A1 | 11/2008 | Battle et al. | |
| 2009/0089959 | A1 | 4/2009 | Lee et al. | |
| 2009/0089960 | A1 | 4/2009 | Lee et al. | |
| 2009/0089961 | A1 | 4/2009 | Kim et al. | |

FOREIGN PATENT DOCUMENTS

| | | | |
|---|---|---|---|
| DE | 3716104 | A1 | 11/1988 |
| DE | 29610123 | U1 | 10/1996 |
| DE | 19525794 | | 1/1997 |
| DE | 102004007031 | | 9/2005 |
| EP | 0983741 | A2 | 2/1986 |
| GB | 1394497 | | 5/1975 |
| GB | 1472384 | | 5/1977 |
| GB | 2325399 | | 11/1998 |
| JP | 03-158125 | | 7/1991 |
| JP | 4-303406 | | 10/1992 |
| JP | 06-178744 | | 6/1994 |
| JP | 2001-070211 | | 3/2001 |
| JP | 2002-233483 | | 8/2002 |
| WO | WO 2008070966 | A1 | 6/2008 |

OTHER PUBLICATIONS

International Search Report for PCT Application No. PCT/US2009/069438 dated Feb. 4, 2010.

Office Action for U.S. Appl. No. 14/193,940 dated Oct. 24, 2014.

Entire new patent prosecution history of U.S. Appl. No. 14/193,940, filed Feb. 28, 2014, entitled, "Vacuum Cleaner Handle Lock and Valve Control.".

* cited by examiner

VACUUM CLEANER WITH RETRACTABLE AUXILIARY SUCTION HOSE

This application is a U.S. National Phase application of PCT International Application No. PCT/SE2010/000306, filed Dec. 17, 2010 and claims the benefit of U.S. Provisional Application No. 61/289,913 filed Dec. 23, 2009, and Swedish Application No. 090161-5, filed Dec. 22, 2009.

FIELD OF THE INVENTION

The invention disclosed herein generally relates to a vacuum cleaner and more precisely to a vacuum cleaner of the upright type having an auxiliary, handheld nozzle for above-floor cleaning.

BACKGROUND OF THE INVENTION

Vacuum cleaners of the upright type, which are also known as stick vacuum cleaners, generally comprise a main body and a floor nozzle. The floor nozzle acts as both a suction nozzle and a (partial) support for the main body against a horizontal surface to be cleaned, such as a floor. In order to support the weight of the main body, the floor nozzle may be rigidly or rotatably connected to the main body, such as by a rigid tube, or may be adjustable to a plurality of predetermined positions to enable use by persons of different body lengths. The floor nozzle may be arranged in such position that the vacuum cleaner is mechanically stable in its operating position. Alternatively, the cleaner is mechanically unstable and needs partial support by the user via a handle or the like; this usually provides a greater operational agility and in some cases makes floor wheels unnecessary.

An upright vacuum cleaner is generally less convenient than a canister vacuum cleaner in the task of cleaning non-horizontal surfaces or areas located at some height above the floor level. To remedy this, upright vacuum cleaners have been endowed with an auxiliary nozzle to facilitate above-floor cleaning. As a first example, U.S. Pat. No. 4,955,106 discloses an upright vacuum cleaner with an auxiliary, handheld wand connected to the fan unit via a suction hose which is retractable into the wand. Further, US 2008/282495 describes an vacuum cleaner with a similar constitution, wherein the auxiliary wand is telescopically contained inside the suction hose when not in use. As another example, U.S. Pat. No. 4,376,322 discloses an upright vacuum cleaner having a flexible, auxiliary suction assembly, consisting of a hose encapsulated in a bendable, fixed-length hose fitting, at the distal end of which is formed an auxiliary suction nozzle. The auxiliary suction assembly is mechanically connected to the main body of the vacuum cleaner at a point near the floor. During operation of the vacuum cleaner, a negative suction pressure is applied to the auxiliary suction assembly also when it is used for floor cleaning. This way, the auxiliary suction assembly is retained onto the main body at its upper endpoint by the suction force exerted by the suction nozzle against a mating surface, at its lower endpoint by the mechanical connection, and along the intermediate portion by magnetic strips attracted to a shallow metal groove with open ends.

However, the problem of storing an auxiliary suction hose in a secure and non-bulky fashion seems to lack a satisfactory solution in the field of upright vacuum cleaners. Likewise, additional improvements appear to be possible as far as accessibility and energy efficiency (minimizing flow resistance) are concerned.

SUMMARY OF THE INVENTION

It is an object of the present invention to reduce or at least mitigate the shortcomings outlined in the previous section. The object is achieved by an upright vacuum cleaner having the features set forth in claim 1. Advantageous embodiments of the invention are defined by the dependent claims.

Thus, according to an aspect of the invention, a vacuum cleaner has a suction chamber, in which a dust filter, cyclone or other dust separator may be arranged, and to which dust-laden air can be sucked from two different ducts under the action of a fan unit. A valve arrangement provided between the two ducts and the suction chamber is operable to establish full, partial or no communication between each of the ducts and the suction chamber. The first suction duct connects the suction chamber to a floor nozzle arrangement, which is used in floor cleaning, whereas the second duct connects to an extensible and/or contractible suction hose, at the distal end of which is provided an auxiliary, preferably handheld nozzle. When not in use, the suction hose—or a substantial portion thereof—can be stowed in an elongated recess provided in a handle means projecting from the main body. The recess may be straight or may have curved portions or bends. The length of the hose when fully extended is preferably about three times its length when fully retracted. Preferably, the length of the recess is such that the greater part of the suction hose can be contained in the recess when the hose is in a non-extended condition (or, if the hose is negatively biased, a collapsed condition). The handle means and the main body may form an integral part—the handle means being then merely an upper extremity of the main body—or may be a separate part connected to the main body. During floor cleaning, the handle means serves to displace the vacuum cleaner to and from; when the vacuum cleaner is used in its above-floor mode—the suction hose may then exert fairly unpredictable forces on its upper portion—a user may enhance its stability by seizing the handle means by his or her free hand. The vacuum cleaner achieves its object because the suction hose is reliably kept in place in the recess during floor cleaning and is easily accessible.

In one embodiment, the suction hose is biased in order to contract maximally when no tensile force acts on it; the hose may be manufactured from an elastomeric material with an internal helical coil or the like, or may be manufactured from a single or composite material with the desired elastic properties. By virtue of the contracting tendency, the suction hose can be readily stowed away into the recess after a period of use. Further, the elastic extensibility of the hose provides for easy access and stowage at transitions between floor and above-floor cleaning. It also ensures that the momentary length of the hose is adapted to the actual cleaning situation, which minimizes the airflow resistance in the hose as a whole.

As an alternative hereto, the suction hose may be negatively biased, tending to relax to a length greater than its fully collapsed length in the absence of an external longitudinal force. To facilitate stowing, the hose may then be collapsed under action of the negative pressure provided by the fan unit if the user covers the suction aperture. After this step, the hose is preferably maintained in its collapsed condition by mechanical or magnetic retention means or the like.

In an advantageous embodiment, the handle means comprises retention means adapted to retain the auxiliary nozzle in a resting position when not in use. Preferably, the retention means are easily releasable. The retention means may be flexible clips engaging around the auxiliary nozzle. Alternatively, the retention means comprises a sleeve fastened onto the handle means or a recess therein, into which a portion of the free (distal) end of the auxiliary nozzle can be inserted for storage. Further alternatively, a boss or pin mounted on the handle means substantially collinearly with the recess and having a diameter somewhat smaller than the inner diameter of the auxiliary nozzle, can serve as a suspension point for the free end of the nozzle. Whatever kind of retention means is chosen, it is preferably located so that it retains the auxiliary nozzle in a position that allows the suction hose to have minimal length (i.e., to be fully collapsed or fully non-extended). This minimizes the bulk occupied by the suction hose when the vacuum cleaner is used in its floor cleaning mode.

In another embodiment, the handle means does not comprise particular retaining means for the auxiliary nozzle. The collapsing or contracting force exerted by the suction hose tends to drag the nozzle into the storage recess, which may provide sufficient retention for a reasonably light-weight nozzle. Moreover, the proximal end of the auxiliary nozzle may fit snugly into the distal end of the recess, thereby retaining the nozzle laterally. Depending on the materials of the recess interior and the proximal end of the nozzle, this effect may be supplemented by a frictional retention in the longitudinal direction.

Advantageously, the retention means comprises a lid arrangement adapted to cover the suction aperture at the free end of the auxiliary nozzle while the auxiliary nozzle is in its resting position. The lid arrangement may consist of a cover plate hinged at one end and spring-loaded to abut against the aperture during floor cleaning. It may also be formed by a cover plate movable in its normal direction and spring-loaded in this direction so as to abut firmly against the aperture of the auxiliary nozzle when this is placed in its resting position. Said cover plate may be arranged inside a storage sleeve, which has substantially the same cross section and the place and into which the tip of the nozzle is inserted for storage. As another alternative, a retention boss or pin for insertion into the suction aperture may provide an air-tight seal. By covering the suction aperture, the lid arrangement prevents communication with the suction chamber of the vacuum cleaner, so that the full suction power is applied to the floor nozzle arrangement. By providing a lid arrangement, one may adopt a relatively simpler valve arrangement which—in combination with the lid arrangement—still provides sufficient air tightness against the auxiliary nozzle in the floor cleaning mode.

In some embodiments, the recess has an open distal end through which the suction hose is free to move. When stowed in its resting position, the auxiliary nozzle may be completely or partially inserted into the recess through this open end; it may however be located entirely outside the recess. The open end may be perpendicular to the recess or be slanted outwardly, away from the handle means, to enhance the mobility of the suction hose during use.

In one embodiment, the distal end of the recess is open and the proximal end is provided with an airtight hose coupling. The hose coupling is fastened near the proximal end and is used to connect the suction hose to the second duct, through which the suction hose communicates with the valve arrangement, which is operable to establish communication with the suction chamber. Hence, in the above-floor cleaning mode of the vacuum cleaner, the suction hose can be regarded as two distinct segments as regards mobility. The proximal segment extends from the hose coupling to the open end of the recess, and the distal segment extends from the open end to the auxiliary nozzle. The proximal segment is only mobile longitudinally, on extension and contraction of the hose, but is restrained laterally by the inner walls of the recess. The distal segment is freely movable and its length can, unlike the length of the proximal segment, be varied by applying various tensile forces to the suction hose; a length increase is then due both to the extension of the distal segment itself and the amount of hose that is being pulled out of the recess. As an advantage of this embodiment, the effective proximal endpoint of the suction hose, on which the mobility and useful range of the auxiliary nozzle depends, is located a substantial distance from the floor nozzle. By tilting the vacuum cleaner as needed, the effective endpoint of the hose can be raised and lowered with respect to the floor level, enabling access to a large range of surfaces to be cleaned.

In an alternative embodiment, both the distal end and the proximal end of the recess are open. The proximal end opens into a passage in the interior of the main body of the vacuum cleaner. The passage may be a dedicated pipe or tube conditioned to contain a suction hose, or may simply be a region of space not occupied by other components. At or near the proximal end of the passage, a hose coupling is provided, by which the suction hose can be connected to the second duct. An advantage of this embodiment, in comparison with the previous embodiment, is that the second duct can be constructed with a low number of bends irrespective of the placement of the handle means relative to the main body. Because the suction hose will relax into a smoothly bent configuration, the airflow resistance will decrease, thereby improving the energy efficiency of the vacuum cleaner. It may also decrease the number of segments needing to be joined together (airtightly) during factory assembly and/or at-home assembly carried out by a user.

In another advantageous embodiment, the recess is open along a substantial portion of its length, preferably the greater part. In other words, one longitudinal aperture opens from the exterior of the handle means—either from its the front side, rear side or a lateral side—into the recess. Preferably, some means for retaining the suction hose in the recess is provided, such as magnetic stripes or releasable (e.g., spring-loaded hinged) cover flaps. As an alternative, the suction hose is somewhat compressible in its radial direction while the longitudinal aperture is slightly narrower than the diameter of the hose in its uncompressed state. This retains the suction hose in the recess when not in use, but enables sideways insertion and removal of the hose upon a light radial compression. As an alternative hereto, the borders of the longitudinal aperture may be fabricated from a depressible, displaceable, flexible or otherwise elastically deformable material—such as rubber, textile or brushes—which enables insertion and removal of the hose even if the latter has a substantially fixed diameter.

In one embodiment of the invention, there is provided at least one viewing aperture into the recess. Each viewing aperture is preferably arranged at a conspicuous location on the vacuum cleaner. Advantageously, this makes the device more intuitive to use. Each viewing aperture may be covered by a completely or partially transparent element, such as a plane or curved plate from glass, plastic or perspex. This may improve the visual appearance of the vacuum cleaner and decrease soiling of the recess.

An important purpose of the valve arrangement is to direct the suction power of the fan unit optimally with respect to the actual use of the vacuum cleaner, be it floor cleaning or above-floor cleaning. To simplify manufacture and enable use of inexpensive components, however, it may be quite sufficient to use a valve arrangement that merely diminishes the flow along the non-desirable path in a given situation, thereby favoring the desirable flow.

In one embodiment, the valve arrangement is operable to a floor cleaning position, corresponding to the floor cleaning mode of the vacuum cleaner, in which communication between the second suction duct and the suction chamber is substantially prevented. A small leakage is normally tolerable. Preferably, in this position, the valve arrangement provides the greatest possible communication between the first duct and the suction chamber.

In still another embodiment, the valve arrangement is operable to an above-floor cleaning position, corresponding to the above-floor cleaning mode of the vacuum cleaner, in which communication between the first suction duct and the suction chamber is reduced. Preferably, the communication between the first suction duct and the suction chamber is substantially prevented to direct all suction power to the auxiliary nozzle. Even so, a small leakage may be tolerable. Preferably, in this position, the valve arrangement provides the greatest possible communication between the second duct and the suction chamber.

In yet another embodiment, the valve arrangement is a two-way valve, which may be positioned in either a first position, establishing communication between the suction chamber and the first duct only, or a second position, establishing communication between the suction chamber and the second duct only.

Advantageously, there are actuating means for operating the valve arrangement in accordance with the presence of the auxiliary nozzle in its resting position or, equivalently, whether it can be assumed to be in use or not. The actuating means may form part of or be integrated into retaining means for the nozzle. Thus, the actuating means is adapted to monitor the presence of the nozzle, its removal from or repositioning into this position. The monitoring may be effected by means of an electric contact which supplies an electric signal encoding the location of the auxiliary nozzle. The electric signal may then operate the valve arrangement, either directly, if the valve arrangement is electrically operable, or via a magnetic contact, servo motor or the like. Alternatively, a magnetic, inductive or capacitive sensor may sense the presence or movements of the auxiliary nozzle. Further alternatively, there may be provided mechanical means which are actuated upon removal or stowing of the auxiliary nozzle and which transmit a mechanical force or movement, such as via a wire or lever, sufficient to reposition the valve arrangement.

Some embodiments are not provided with actuating means, but the valve arrangement is operated manually. If the valve arrangement is repositionable by a translation movement, a sliding control button may be provided on the outside of the main body, preferably near the valve arrangement. If the valve arrangement is repositionable by a rotary movement, a rotating knob may be provided similarly.

In an advantageous embodiment, the placement of the valve arrangement is such that the first suction ducts is favored, if necessary at the expense of the second suction duct. For instance, the valve arrangement may be located between the suction chamber and the floor nozzle arrangement, so that the first duct is shorter than the second duct. Moreover, the first duct may be straighter (comprise fewer sharp bends) than the second duct by virtue of the valve arrangement being located somewhere on a line segment from the suction chamber to the floor nozzle arrangement. Further, the first duct may have larger least diameter than the second. Thus, to a certain extent, the floor cleaning mode is favored over the above-floor cleaning mode. This increases the overall energy economy of the vacuum cleaner, for over a normal life cycle of the vacuum cleaner, the floor cleaning mode is the dominating one in terms of time.

These and other aspects, features and advantages of the invention will become apparent by a study of the embodiments described hereinafter.

BRIEF DESCRIPTION OF THE DRAWINGS

Embodiments of the present invention will now be described in more detail with reference to the appended drawings, of which.

DETAILED DESCRIPTION OF EMBODIMENTS

Figure 1:
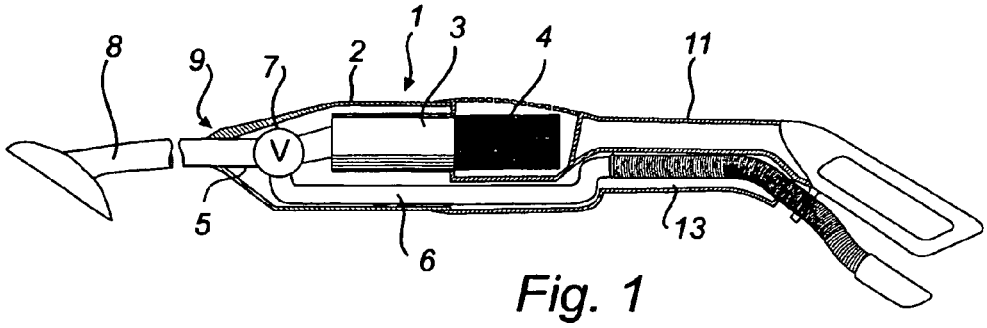
FIG. 1 is a cross-sectional side view of an upright vacuum cleaner according to an embodiment of the present invention.

FIGS. 1 and 2 show a vacuum cleaner 1, according to a first embodiment of the invention. The vacuum cleaner 1 generally consists of a main body 2 connected to a handle means 11 and to a floor nozzle arrangement 8. The floor nozzle arrangement 8 may comprise a tube extending from a lower end 9 of the main body to the actual floor nozzle, which may comprise brushes, mechanical agitators, wheels etc. as required for the intended use of the vacuum cleaner 1. In the main body 2, there is provided a fan unit 4 for reducing the pressure in a suction chamber 3 to a sub-atmospheric level for thereby sucking in a dust-laden air stream from a floor nozzle, suction hose or the like. The suction chamber 3. comprises conventional dust-separating and/or dust-collecting means. The fan unit 4 expels the air stream, now with a reduced dust content, out of the main body 2. The air stream into the suction chamber 3 is controlled by a valve arrangement 7, which is operable to establish communication with a first suction duct 5 and/or a second suction duct 6. The valve arrangement 7 may be a conventional valve or arrangement of valves suitable for diverting air streams. It may be actuated by electric or mechanical action.

The first duct 5 is connected to the floor nozzle arrangement 8. The second duct 6 is connected to an extensible suction hose 12 (that is, the suction hose is biased so as to contract maximally in the absence of an external tensile force), at the distal end of which is arranged an auxiliary nozzle 10, on which, in turn, a user may fit various special suction or working nozzles (not shown) in a releasable manner. As is readily seen in FIG. 1, the air path is substantially shorter in the floor cleaning mode of the vacuum cleaner, wherein air is sucked via the first duct 5, than in the above-floor cleaning mode, when the second duct 6 communicated with the suction chamber. Moreover, to leave the necessary room for the suction chamber 3 and the fan unit 4, the second duct 6 runs in several sharp bends from the hose 12 to the valve arrangement 7. Hence, the air duct configuration favors the floor cleaning mode to a certain extent. For domestic purposes, representative values of the airflow during idling are around 30 liters/second from the floor nozzle arrangement and around 20 liters/second from the auxiliary nozzle.

Figure 2A:
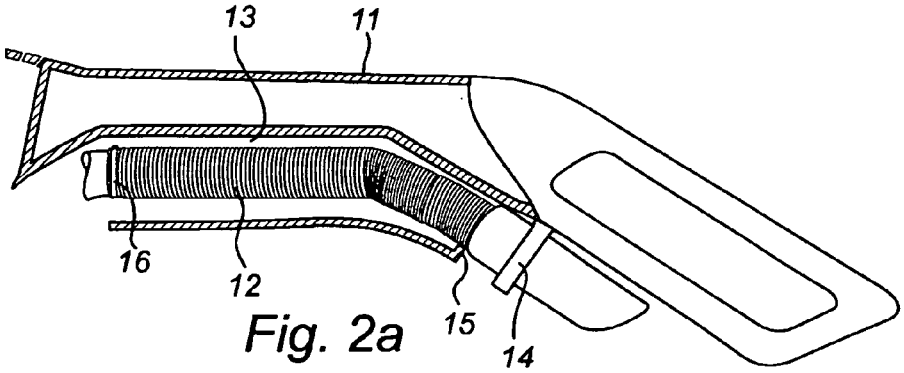
FIGS. 2*a* and 2*b* are cross-sectional side views showing the upper portion of the vacuum cleaner in FIG. 1, the cleaner being shown in two different operating modes.
Figure 2B:
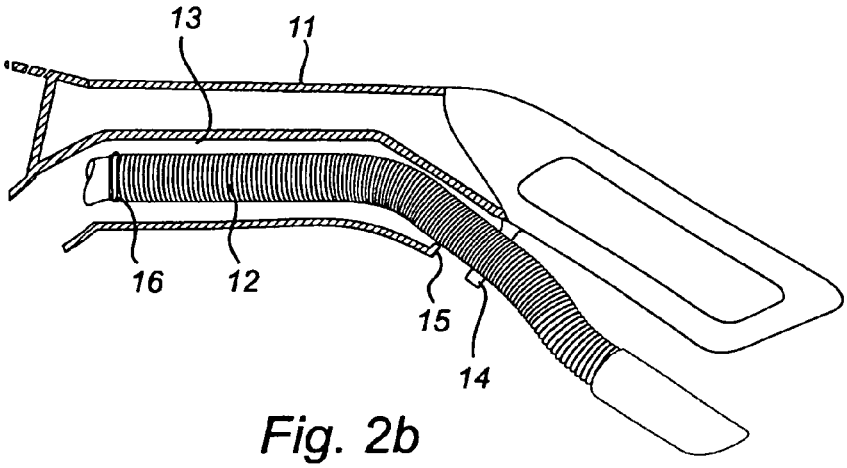

In order to provide for convenient storage of the suction hose 12, an elongated, preferably cylindrical recess 13 is provided in the handle means 11 portion of the vacuum cleaner. As outlined above, the hose 12 extends out of and contracts back into the recess 13, in accordance with the actual use situation, through an open distal end 15 of the recess 13. FIG. 2*a* shows the hose in its resting position, when it is fully contracted, and FIG. 2*b* shows it in use, in the above-floor cleaning mode of the vacuum cleaner.

In this embodiment, the length of the recess 13 is substantially equal to that of the contracted hose 12, whereby some portion of the auxiliary nozzle 10 may be present in the recess 13 when the hose 12 is in its resting position. The length of the recess 13 is not essential to its function as long as a substantial portion, preferably the greater part of the hose 12 can be contained in the recess 13.

In this embodiment, further, a retaining means in the form of an elastic clip 14 engages around a portion of the periphery of the auxiliary nozzle 10 when this is placed in its resting position and snaps off when the nozzle 10 is removed.

In this embodiment, the hose 12 connects to the second suction duct 6 by means of an air-tight hose coupling 16 arranged at the proximal end of the recess 13.

In other embodiments, the retaining means may include or consist of a lid arrangement covering the suction aperture of the auxiliary nozzle when this is in its resting position, thereby substantially preventing air to be sucked by the nozzle. As already discussed, the lid may be arranged in a rotatable manner (hinged) or may be linearly movable. To achieve a similar air sealing effect, the end of the auxiliary nozzle may be suspended on a fixed boss or pin fitting snugly against the suction aperture during storage.

Figure 3:
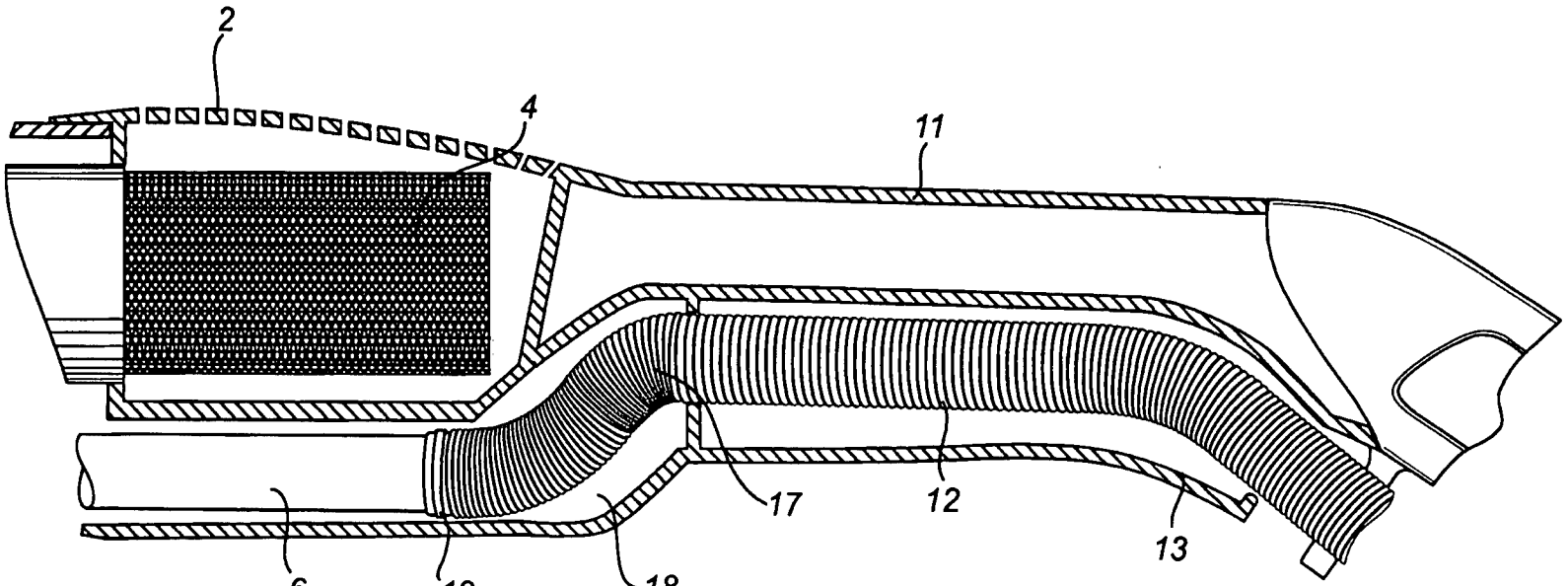
FIG. 3 is a cross-sectional side view of a middle portion of a vacuum cleaner according to another embodiment of the invention.

FIG. 3 shows an alternative way of connecting the suction hose 12 to the first suction duct 6. This solution is preferable because it reduces the air-flow resistance from the auxiliary nozzle 10 to the suction chamber 3 by avoiding sharp bends in the flow path. The method is also preferable with respect to the manufacture of the second duct, which can be made straighter. In particular, if the second duct is manufactured from straight segments and prefabricated bends or the like, then a straighter shape of the duct may help reduce the number of joints needed. An additional advantage concerns the packaging of the vacuum cleaner and its transport to the end consumer. Namely, the rigid components are preferably delivered in an assembled condition, that is, the end consumer is not entrusted with the airtight joining of segments of a duct if this is needed. For this reason, the length of the longest ducts implies that the vacuum cleaner package has a certain minimum size. If a portion of the duct is replaced by a flexible hose, which can be rolled up during transport, then it may be possible to decrease the overall size of the product package.

As shown on FIG. 3, the suction hose 12 runs from the proximal end 17 of the recess 13 onwards through a passage 18, where it is air-tightly connected to the first duct 6 via a hose coupling 19. The extent of the passage 18 is defined by the inner surface of the main body 2, the exterior of the fan unit 4 and possibly other components as well. The hose 12 may share the passage 18 with other electric or mechanical cables, such as a mechanical actuation wire (cf. FIG. 5) or electric wiring. Preferably, the hose 12 is freely movable in the passage 18, thus allowing substantially the full length of the hose 12 to extend and contract.

Figure 4:
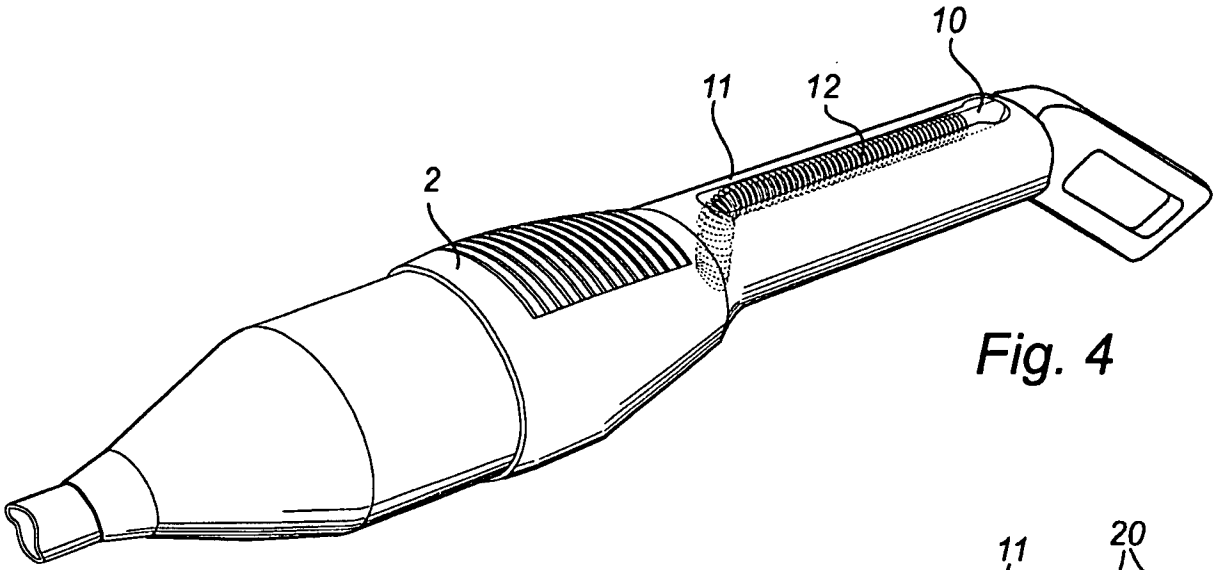
FIG. 4 is a frontal perspective view of a vacuum cleaner according to yet another embodiment of the invention.

In the vacuum cleaner shown in FIG. 4, the recess 13 for storing the suction hose 12 has the shape of an open groove. In this embodiment, the recess 13 opens towards the front side of the handle means 11. (The recess could equally well be provided in the rear, right or left side of the handle means 11; on the rear side the recess is less visible, but the downward gravity force does not contribute to retaining the hose in the recess.) Thus, there is a longitudinal aperture (slit) providing access into the recess 13 along a substantial portion of its length, preferably along its full length to ensure maximal accessibility to the hose 12 when stored. As already discussed above, it is advantageous to choose the width of the aperture to be slightly smaller than the diameter of the hose 12 in order to ensure that it is safely retained in the floor cleaning mode. However, to enable the hose 12 to be inserted into and removed from the recess 13, the hose is elastically compressible and/or the border of the aperture is elastically deformable. It is also advantageous to allow a slightly larger width of the aperture near its proximal end, through which the hose 12 normally passes during above-floor cleaning. This avoids inadvertent strangulation of the hose 12 and helps reduce wear. Further, the recess 13 opens, at its proximal end, towards a passage (not shown) in the main body 2 of the vacuum cleaner, as shown in more detail in FIG. 3. In an alternative embodiment, the recess 13 may instead be provided with a hose coupling arranged at the proximal end of the recess 13.

Figure 5:
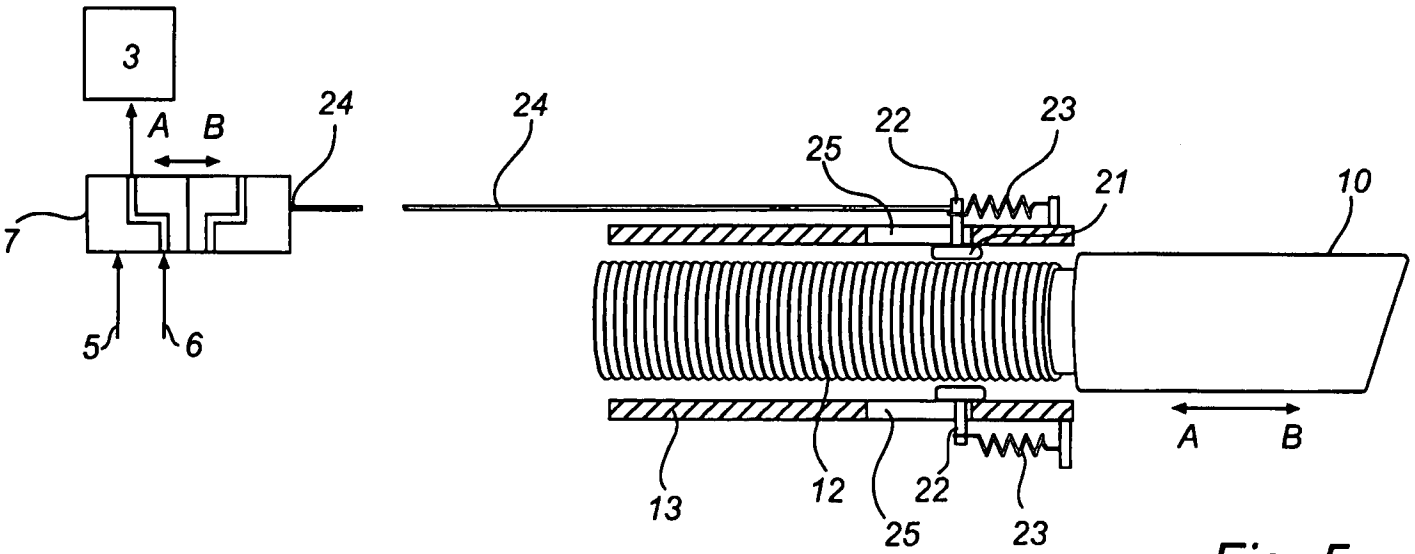
FIG. 5 shows a valve actuating means arranged at a distal end of a storage recess for the suction hose, in accordance with an embodiment of the invention.

FIG. 5 shows a distal end of the recess 13 in an embodiment similar to that shown in FIGS. 1 and 2. The recess 13 is provided with exemplary actuating means for operating the valve arrangement (not shown in FIG. 5) responsive to the presence or absence of the auxiliary nozzle 10 in its resting position. More precisely, the actuating means comprise an inner sleeve 21 contained in a distal segment of the recess 13 and comprising, in this embodiment, two pins 22 extending outwardly from the sleeve 21. The outer diameter of the sleeve 21 is slightly smaller than the inner diameter of the recess 13, so that a small amount of play is provided, allowing the sleeve 21 to move with small friction in the longitudinal direction. Each pin 22 is inserted into a longitudinal through slot 25 in a wall of the recess 13, whereby the sleeve 21 is restrained to non-rotating, linear motion between the endpoints of each slot 25. The actuating means further comprises springs 23 arranged to bias the pins 22 in direction B, that is, towards the distal endpoint of the allowed path of the sleeve 21. The position of the sleeve 21 is transmitted via a wire 24, which is preferably enclosed in a rigid longitudinal casing (not shown) allowing it to transmit both compressive and tensile forces. The wire 24 extends from the sleeve 21 to the valve arrangement 7 (drawn schematically in this figure), which is switchable between its floor cleaning position (communication between the first duct 5 and the suction chamber 3; direction A) and its above-floor cleaning position (communication between the second duct 6 and the suction chamber 3; direction B). FIG. 5 shows the auxiliary nozzle 10 located out of its resting position. When inserted into the recess 13 more fully, the proximal end of the auxiliary nozzle 10 will abut against the sleeve 21, pushing it in direction A and thereby causing the wire 24 to switch the valve arrangement 7 into its floor cleaning position. Conversely, when the auxiliary nozzle 10 is removed from its resting position and extracted from the recess 13, the springs 23 will restore the sleeve 21 in direction B, causing the wire 24 to reset the valve arrangement 7 in its above-floor cleaning position.

Figure 6:
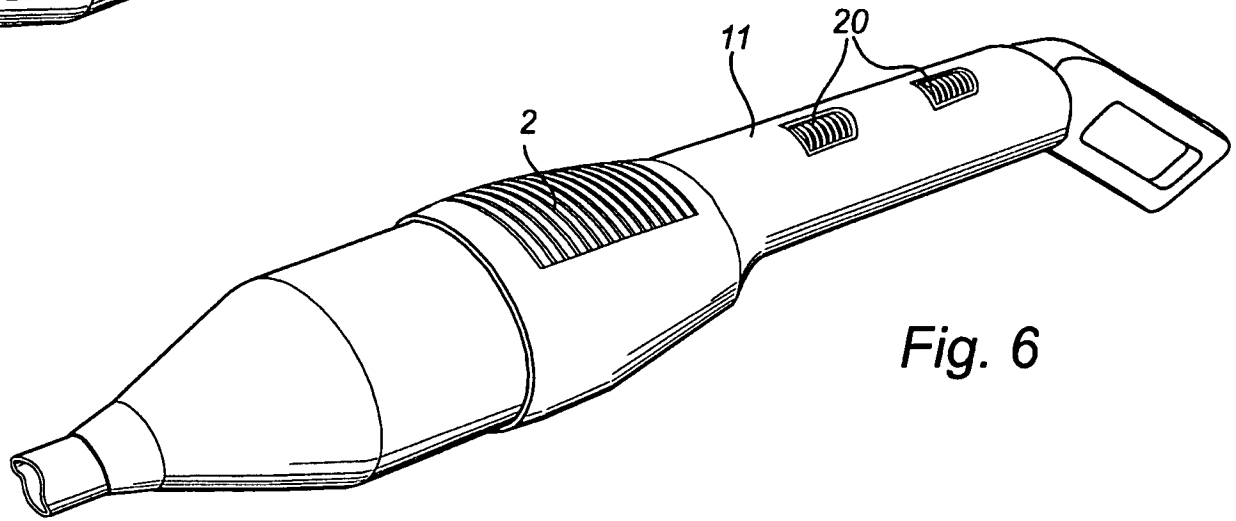
FIG. 6 is a frontal perspective view of a vacuum cleaner according to another embodiment of the invention.

FIG. 6 shows a vacuum cleaner which, according to an embodiment of the invention, has two viewing apertures 20 through which the suction hose 12 is visible. In the embodiment shown on the drawing, the distal end of the hose storage recess opens to the rear side of the handle means 11, whereas the viewing apertures 20 are provided on the front side. Advantageously, the viewing apertures 20 are covered by transparent plates (not shown) which ensure evenness of the front surface. Apart from their aesthetic function, the viewing apertures fulfill an explanatory task in informing or reminding a user of the existence of the auxiliary suction hose 20.

Embodiments of the vacuum cleaner according to the present invention as defined by the appended claims have been described above. These embodiments should be seen as merely non-limiting examples. As a person skilled in the art will realize, many modifications and alternative embodiments are possible without departing from the scope of the invention. It is to be noted that for the purpose of this application, and in particular with regard to the appended claims, the word "comprising" does not exclude other elements, nor does the indefinite article "a(n)" exclude a plurality, which per se will be apparent to the skilled person.

The invention claimed is:

1. An upright vacuum cleaner, comprising:
a main body having arranged therein:
a suction chamber,
a fan unit operable to reduce the pressure in the suction chamber to a sub-atmospheric level,
a first suction duct,
a second suction duct, and
a valve arrangement operable to establish communication between each of the first and second suction ducts and the suction chamber;
a floor nozzle arrangement provided at a first end of the main body and in communication with said first suction duct;
an auxiliary nozzle for above-floor cleaning;
an extensible and/or collapsible suction hose connecting the auxiliary nozzle to said second suction duct;
handle means projecting from the main body substantially opposite to said first end of the main body, wherein the handle means comprises an elongated recess adapted to contain the greater part of the suction hose;
the handle means further comprises retention means adapted to retain the auxiliary nozzle in a resting position, wherein the retention means comprises actuating means for sensing a presence of the auxiliary nozzle in its resting position and, responsive thereto, operating the valve arrangement accordingly; and
wherein the recess has an open distal end, through which the suction hose is freely movable upon extension or contraction of the hose; and
wherein the retention means comprises a lid arrangement adapted to obstruct the auxiliary nozzle when the latter is in its resting position, thereby preventing communication between the auxiliary nozzle and the suction chamber.

2. A vacuum cleaner according to claim 1, wherein the suction hose is provided with biasing means.

3. A vacuum cleaner according to claim 1, wherein a hose coupling, which is fastened at a proximal end of the recess, connects the suction hose to said second suction duct.

4. A vacuum cleaner according to claim 1, wherein a proximal end of the recess opens into a passage provided inside the main body and adapted to contain a portion of the suction hose; and wherein a hose coupling, which is fastened at a proximal end of the passage, connects the suction hose to said second duct.

5. A vacuum cleaner according to claim 1, wherein the recess comprises a portion that is open along a greater part of the recess' length, so as to enable sideways insertion and removal of the suction hose at the portion that is open.

6. A vacuum cleaner according to claim 1, further comprising at least one viewing aperture into the recess.

7. A vacuum cleaner according to claim 6, wherein said viewing aperture is covered by a transparent element.

8. A vacuum cleaner according to claim 1, wherein the valve arrangement is operable to a floor cleaning position, in which communication between the second suction duct and the suction chamber is substantially prevented.

9. A vacuum cleaner according to claim 8, wherein the valve arrangement is further operable to an above-floor cleaning position, in which communication between the first suction duct and the suction chamber is reduced.

10. A vacuum cleaner according to claim 9, wherein the valve arrangement is a two-way valve, alternatively establishing communication between the suction chamber and either the first suction duct or the second suction duct.

11. A vacuum cleaner according to claim 1, wherein the first suction duct is substantially shorter than the second suction duct.

12. An upright vacuum cleaner, comprising:
a main body having arranged therein:
a suction chamber,
a fan unit operable to reduce the pressure in the suction chamber to a sub-atmospheric level,
a first suction duct,
a second suction duct, and
a valve arrangement operable to establish communication between each of the first and second suction ducts and the suction chamber;
a floor nozzle arrangement provided at a first end of the main body and in communication with said first suction duct;
an auxiliary nozzle for above-floor cleaning;
an extensible and/or collapsible suction hose connecting the auxiliary nozzle to said second suction duct;
handle means projecting from the main body substantially opposite to said first end of the main body, wherein the handle means comprises an elongated recess adapted to contain the greater part of the suction hose; and
the handle means further comprises retention means adapted to retain the auxiliary nozzle in a resting position, wherein the retention means comprises an actuating means for sensing a presence of the auxiliary nozzle in its resting position and, responsive thereto, operating the valve arrangement accordingly; and
wherein the retention means comprises a lid arrangement adapted to obstruct the auxiliary nozzle when the latter is in its resting position, thereby preventing communication between the auxiliary nozzle and the suction chamber.

13. An upright vacuum cleaner, comprising:
a main body having arranged therein:
a suction chamber,
a fan unit operable to reduce the pressure in the suction chamber to a sub-atmospheric level,
a first suction duct,
a second suction duct, and
a valve arrangement operable to establish communication between each of the first and second suction ducts and the suction chamber;
a floor nozzle arrangement provided at a first end (9) of the main body and in communication with said first suction duct;
an auxiliary nozzle for above-floor cleaning;
an extensible and/or collapsible suction hose connecting the auxiliary nozzle to said second suction duct;
handle means projecting from the main body substantially opposite to said first end of the main body, wherein the handle means comprises an elongated recess adapted to contain the greater part of the suction hose;

the handle means further comprises retention means adapted to retain the auxiliary nozzle in a resting position, wherein the retention means comprises actuating means for sensing a presence of the auxiliary nozzle in its resting position and, responsive thereto, operating the valve arrangement accordingly; and at least one viewing aperture into the recess; and wherein the retention means comprises a lid arrangement adapted to obstruct the auxiliary nozzle when the latter is in its resting position, thereby preventing communication between the auxiliary nozzle and the suction chamber.

* * * * *